US005385680A

United States Patent [19]

Didier et al.

[11] Patent Number: 5,385,680

[45] Date of Patent: Jan. 31, 1995

[54] FINISHING PROCESS FOR TEXTILES, FINISHING BATH FOR TEXTILES USING PHOSPHINICOSUCCINIC ACID, PHOSPHINI COBISSUCCINIC ACID OR THEIR MIXTURES, FINISHED TEXTILES AND USE OF SAID ACIDS AS FINISHES

[75] Inventors: Wilhelm Didier, Issy Les Moulineaux; Gelabert Antonio, Bouffemont-Moisselles, both of France

[73] Assignee: Societe Francaise Hoechst, Puteaux, France

[21] Appl. No.: 185,149

[22] Filed: Jan. 24, 1994

Related U.S. Application Data

[62] Division of Ser. No. 41,463, Apr. 2, 1993, Pat. No. 5,300,240.

[30] Foreign Application Priority Data

Apr. 3, 1992 [FR] France ..... 92 04076

[51] Int. Cl.[6] ..... D06M 13/184; D06M 13/188; D06M 13/192

[52] U.S. Cl. ..... 252/8.6; 8/115.64; 8/120; 8/127.1; 428/274

[58] Field of Search ..... 252/8.6; 8/115.64, 120, 8/127.1; 428/274

[56] References Cited

U.S. PATENT DOCUMENTS

| | | | |
|---|---|---|---|
| 3,300,337 | 1/1967 | Cooper | 117/139.5 |
| 3,535,073 | 10/1970 | Chance et al. | 8/120 |
| 3,979,533 | 9/1976 | Moreau | 427/390 |
| 4,088,678 | 5/1978 | Matt et al. | 260/502.4 R |
| 4,138,431 | 2/1979 | Riess et al. | 260/502.4 P |
| 4,447,242 | 5/1984 | Benisek | 8/128 R |
| 4,590,014 | 5/1986 | Wolf et al. | 260/502.4 R |
| 4,632,741 | 12/1986 | Wolf et al. | 204/157.73 |
| 4,936,865 | 6/1990 | Welch et al. | 8/120 |
| 5,018,577 | 5/1991 | Paidre et al. | 166/279 |
| 5,023,000 | 6/1991 | Kreller et al. | 210/697 |
| 5,273,549 | 12/1993 | Dicher et al. | 8/127.1 |
| 5,300,240 | 4/1994 | Wilhelm et al. | 252/8.6 |

FOREIGN PATENT DOCUMENTS 0484196 10/1991 European Pat. Off. .

*Primary Examiner*—Paul Lieberman
*Assistant Examiner*—Michael P. Tierney
*Attorney, Agent, or Firm*—Browdy and Neimark

[57] ABSTRACT

Process for finishing a textile in which the textile to be treated is impregnated using a finishing bath containing phosphinicosuccinic acid (I), phosphinicobissuccinic acid (II) or a mixture of phosphinicosuccinic acid (I) and phosphinico-bissuccinic acid (II), finishing bath, finished textile and use of previously-mentioned acids as textile finishes or as cross-linking agents for cellulose.

5 Claims, No Drawings

FINISHING PROCESS FOR TEXTILES, FINISHING BATH FOR TEXTILES USING PHOSPHINICOSUCCINIC ACID, PHOSPHINI COBISSUCCINIC ACID OR THEIR MIXTURES, FINISHED TEXTILES AND USE OF SAID ACIDS AS FINISHES

This is a division of application Ser. No. 08/041,463 filed Apr. 2, 1993, now U.S. Pat. No. 5,300,240.

The present invention relates to a finishing process for textiles, a finishing bath for textiles using phosphinicosuccinic acid, phosphinicobissuccinic acid or their mixtures, finished textiles and the use of said acids as finishes.

Textile finishes are today commonly used to give crease-resistant properties to cellulose fabrics, but most of them contain free or combined formaldehyde, which is released either in the finishing workshops or when the fabrics thus finished are used.

Now, formaldehyde is today considered as a harmful product the doses of exposure to which are limited to very small amounts by certain national regulations. Therefore textile finishes which contain no trace of formaldehyde are actively sought. During this research, the Applicant has discovered with astonishment that phosphinicosuccinic acid (I) and phosphinicobissuccinic acid (II) have very useful cross-linking properties for cellulose, which justify their use as a textile finish.

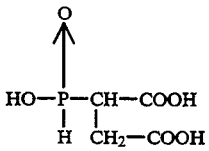

(I)
$C_4H_7O_6P$

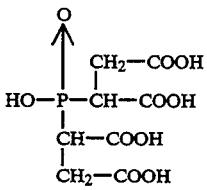

(II)
$C_8H_{11}O_{10}P$

Phosphinicosuccinic acid (I) as well as phosphinicobissuccinic acid (II) are described in the literature (U.S. Pat. No. 5,018,577). They are notably obtained by the addition of an alkali metal hypophosphite such as sodium hypophosphite to maleic acid, a dialkyl maleate or maleic anhydride followed, if necessary, by an acid or basic hydrolysis of the ester functions, when a dialkyl maleate is used as starting product. This addition reaction is generally catalyzed with a mineral peroxide derivative such as sodium persulphate, or an organic peroxide derivative such as tertiobutyl 2-ethyl perhexanoate, TBPEH; it can also be carried out under ultraviolet radiation in acetone (French Patent No. 2356658, U.S. Pat. Nos. 4,138,431, 4,590,014, 4,632,741, 5,023,000, 5,018,577, 4,088,678 and Beil. IV, 4th suppl., page 3497, 1959).

Phosphinicosuccinic acid (I) and phosphinicobissuccinic acid (II), as well as their mixtures in variable proportions, have, as has been said previously, very useful cross-linking properties for cellulose, which justify their use as textile finishes, to give crease-resistant properties to cellulose fabrics.

Therefore a subject of the present invention is a process for finishing textiles characterized in that the textile to be treated is impregnated using a finishing bath containing phosphinicosuccinic acid (I), phosphinicobissuccinic acid (II), or a mixture of these two acids. This mixture can be in variable proportions.

In the preferred conditions for implementing the invention, the textile finishing bath is partially neutralized with an alkali metal hydroxide in order to obtain a finishing bath having a pH of 2 to 7.

In other preferred conditions, the finishes described above are characterized in that they do not contain a catalyst, of whatever nature.

Also a subject of the present Application is a textile finishing bath, characterized in that it contains a solution of phosphinicosuccinic acid (I), phosphinicobissuccinic acid (II), or their mixture partially neutralized to pH 2 to 7 with an alkali metal hydroxide, and notably the baths described in the examples.

The above solutions are preferably aqueous solutions; they advantageously have added to them a wetting agent which is well known from the state of the art.

Also a subject of the present Application is finished textiles, characterized in that they are obtained by implementing the process described above.

Also a subject of the present invention is the use, as a textile finish, of phosphinicosuccinic acid (I), phosphinicobissuccinic acid (II), or one of their mixtures.

Finally a subject of the present invention is the use of phosphinicosuccinic acid (I), phosphinicobissuccinic acid (II) or their mixtures in variable proportions as cross-linking agents for cellulose contained in particular in textile fibres, wood shavings, sawdust.

The following examples are given for information only; they allow a better understanding of the invention, but they do not limit its scope. Except where indicated to the contrary, the parts and percentages are given by weight. The crease-resistance test is carried out according to the AATCC 66-1972 standard on samples as they are and on samples which have undergone three washes at 60° C. in a domestic machine; the crease recovery is expressed by the sum of the angles of crease recovery obtained in the direction of the warp and in the direction of the weft. The resistance to traction of the samples expressed in dan in the direction of the warp plus the direction of the weft is carried out according to the AFNOR G 07,001 standard. The yellowing of the fabric, carried out on a FIXOTEST apparatus at 200° C. for 30 seconds and the whiteness expressed in degrees Berger, are measured with a spectrophotometer. The amount of residual formaldehyde on the fabric is determined according to the method described in the Japanese law 112-1973; in the fabrics of the examples, no formaldehyde could be detected.

EXAMPLE 1

A solution constituted by:

150 g (1 mole) of 96% dimethyl maleate, 2 g (9.2 mmoles) of tertiobutyl 2-ethyl perhexanoate, 99 g of absolute ethanol, is introduced dropwise, over 150 minutes and under agitation, into a solution maintained at 80° C. and constituted by:

44 g (0.485 mole) of 97% sodium hypophosphite, 60 g of distilled water, 99 g of absolute ethanol, then the reaction mixture is left for two hours under agitation at 80° C. The reaction solution is then concentrated to about 80% under reduced pressure, then it is diluted with 300 g of water and finally it is washed twice with 150 g of diethyl oxide, and the united ethereal phases are washed once with 50 g of water. The aqueous phases are then united and concentrated to dryness under reduced pressure. In this way 197.2 g of a viscous paste is obtained containing mainly the sodium salt of dimethyl acid phosphinicobissuccinate (about 95%) and traces of sodium hypophosphite and the sodium salt of dimethyl acid phosphinicosuccinate acid.

This product is then heated to boiling point in 555 g of distilled water and 216 g of concentrated hydrochloric acid, d=1.19, while eliminating the methanol formed by distillation. After heating for 5 hours, there is no longer any formation of methanol, the reaction mixture is then concentrated to dryness, under reduced pressure. In this way 185 g of a viscous paste is obtained which is dissolved hot in 350 g of acetic acid. The hot solution thus obtained is treated with 1 g of activated charcoal, then it is filtered and finally concentrated to dryness under reduced pressure. In this way 143.7 g of a white crystallized product is obtained, that being a yield of 99.4% of the calculated theoretical amount relative to the sodium hypophosphite used. This product, analyzed by potentiometric analysis, contains 15.49 meq/g of acid functions of which 2.756 meq/g of strong acid functions, that is a ratio between the carboxylic acid function and the phosphinic acid function of 4.62:1 (theoretical ratio 4:1).

These examinations show that the phosphinic acid function is partially salified with sodium. This product is then treated in solution in 1 kg of distilled water at ambient temperature for one hour with 350 ml of a cation-exchange resin in acid form, having a total exchange capacity of 1.4 meq per ml, then the suspension is filtered and the filtrate is concentrated to dryness under reduced pressure. In this way 135 g of white crystallized product is obtained containing 16.28 meq/g of acid functions (theoretical amount 16.77 meq/g) of which 3.39 meq/g of the acid functions have a pK value of less than or equal to 1.6 (theoretical value 3.35). This product contains about 97% of phosphinico-bissuccinic acid (II), it is used in this form for the application under reference A; NMR$^{13}$C($D_2O$), 25 MHz, $\gamma$32.1 (s, $CH_2$), $\gamma$32.9 (s, $CH_2$), $\gamma$45.7 (d, J=82 Hz, CH), $\gamma$175 (2d, J=4 Hz, CH—$\underline{C}$OOH), $\gamma$177.4 (dd, J=16 Hz, $CH_2$—$\underline{C}$OOH).

EXAMPLE 2

A solution constituted by:

75 g (500 mmoles) of 96% dimethyl maleate, 2 g (9.2 mmoles) of tertiobutyl 2-ethyl perhexanoate, 99 g of absolute ethanol, is introduced dropwise under agitation into a solution maintained at 80° C. and constituted by:

59 g of distilled water, 44 g (485 moles) of 97% sodium hypophosphite, 99 g of absolute ethanol, then the reaction solution is left under agitation for 3 hours at 80° C. before being concentrated to dryness under reduced pressure. The solid residue thus obtained, dissolved in 250 g of water, is washed twice with 150 g of diethyl oxide, then the united ethereal phases are washed once with 50 g of distilled water. The united aqueous phases are then concentrated to dryness under reduced pressure. In this way 118.4 g of a viscous paste is obtained which is dissolved in 600 g of distilled water. This solution is then heated to boiling point in the presence of 142 g of concentrated hydrochloric acid, d=1.19, while distilling the methanol formed. After heating under reflux for 5 hours, there is no longer any methanol formed. The reaction mixture is then concentrated to dryness under reduced pressure. 125 g of product is obtained which is dissolved in 185 g of hot acetic acid. This solution produces, after cooling down to ambient temperature, 6.9 g (58.5 mmoles) of pure crystallized succinic acid. The filtrate obtained after separation of this crystallized product is concentrated to dryness under reduced pressure. In this way 91 g of a viscous product is obtained, the analysis of which by NMR of the proton shows that it is constituted by a mixture, in approximately equi-molar quantity, of succinic acid, phosphinicobissuccinic acid (II), and phosphinicosuccinic acid (I), NMR$^{13}$C ($D_2O$), 25 MHz, $\gamma$31.2 (s, $CH_2$), $\gamma$46.9 (d, J=77 Hz, CH), $\gamma$174.8 (s, CH—$\underline{C}$OOH), $\gamma$177.3 (d, J=16 Hz, $CH_2$—$\underline{C}$OOH). By potentiometric analysis, 16.58 meq/g of acid functions are found, of which 4.56 meq/g are acid functions having a pK value of less than or equal to 1.8. This product is used in this form for the application under reference B.

EXAMPLES 3 AND 4 AND COMPARATIVE EXAMPLE C1

A 100% cotton poplin fabric, which has been scoured and bleached, weighing about 130 g per square meter with a 75% wring-out rate, is impregnated in a padding machine in an aqueous bath the pH of which is adjusted with soda to the value indicated in table I, containing in solution the quantities of acid, as well as 2 g per liter of nonylphenol ethoxylated with 10 moles of ethylene oxide as wetting agent. The fabric is then dried for 45 seconds at 120° C., then it is thermally treated for 90 seconds at 180° C. on a laboratory stenter.

The following are then determined on samples of the treated fabric after conditioning:

crease recovery on samples as they are and on samples which have undergone three washes at 60° C. in a domestic machine, resistance to traction, called Rt, expressed in daN, whiteness, called Wh, expressed in degrees Berger, yellowing, called Ye, the results obtained are given in table I.

The Comparative Example C1 corresponds to the non-treated fabric.

It is observed that the products according to the present invention considerably improve the crease-resistance qualities of the fabrics treated even after washing, without however lowering their resistance to traction too much.

EXAMPLE 5

625 g of distilled water and 490.3 g (5 moles) of maleic anhydride are mixed together under agitation at ambient temperature. The suspension obtained is heated to 60° C. until a solution is obtained. Then 220 g (2.5 moles) of sodium hypophosphite is introduced, then over 5 hours, while main-taining agitation and maintaining the temperature at 60° C., a solution of 45.2 g (0.19 mole) of sodium persulphate in 78 g of distilled water is introduced. After the introduction is complete, the reaction solution is maintained for two hours at 60° C. then it is cooled down to ambient temperature.

In this way 1435 g of a slightly coloured, clear, aqueous solution is obtained, containing about 2.5 moles of monosodium phosphinicobissuccinic acid, having an acidity of 7.0 meq/g (theoretical amount 6.97 meq/g) and no longer containing any maleic anhydride. This solution, called D, is used in this form in Example 8.

EXAMPLE 6

Example 5 is reproduced by replacing the sodium persulphate with an equivalent quantity of ammonium persulphate. In this way about 1464 g of a colourless, clear, aqueous solution is obtained, containing about 2.5 moles of monosodium phosphinicobissuccinic acid, having an acidity of 6.96 meq/g (theoretical amount 6.83 meq/g) and no longer containing any maleic anhydride, determined by NMR analysis of the proton and of $^{13}C$. This solution, called E, is used in this form in Example 9.

EXAMPLE 7

763 g of distilled water and 327.5 g (3.34 moles) of maleic anhydride are mixed together under agitation at ambient temperature. The suspension obtained is then heated at 60° C. until a solution is obtained. While maintaining agitation and maintaining the temperature of the solution at 60° C., on the one hand a solution of 28.6 g (0.12 mole) of sodium persulphate in 52 g of distilled water, and on the other hand a solution of 147 g (1.67 mole) of sodium hypo-phosphite dissolved in 300 g of distilled water are introduced over 3 hours, separately and simultaneously. Once the introductions are complete, the reaction solution is left for 2 hours at 60° C.

After cooling down to ambient temperature, about 1618 g of a clear and colourless aqueous solution is obtained, containing about 1.67 mole of monosodium phosphinicobissuccinic acid and no longer containing any maleic anhydride, determined by NMR analyses of the proton and of $^{13}C$. This solution has an acidity of 4.11 meq/g (theoretical amount 4.13 meq/g). This solution, called F, is used in this form in Example 10.

TABLE I

| EXAMPLES | ACID Nature | ACID Qty | PH of the bath | Crease recovery as is | Crease recovery after 3 washes | Rt | Wh | Ye |
|---|---|---|---|---|---|---|---|---|
| 3 | A | 44 | 2.14 | 250 | 210.5 | 74.3 | 69.4 | 63.3 |
| 4 | B | 41.3 | 2.17 | 240 | 212 | 76.2 | 70.8 | 62.5 |
| C1 | | 0 | | 196 | 202 | 106.7 | 72 | 69.2 |
| 8 | D | 121 | 1.77 | 260 | 231 | 67.9 | 72 | 67 |
| 9 | E | 122 | 1.79 | 257.5 | 233 | 69.6 | 70.8 | 65.7 |
| 10 | F | 207 | 1.74 | 253 | 233 | 68.8 | 68.2 | 62 |

We claim:

1. Finished textile, characterized in that it is obtained by impregnating said textile with a finishing bath containing phosphinicosuccinic acid (I), phosphinicobissuccinic acid (II) or a mixture of phosphinicosuccinic acid (I) and phosphinicobissuccinic acid (II).

2. Finished textile according to claim 1, characterized in that the finishing bath has a pH of 2 to 7 obtained with an alkali metal hydroxide.

3. Finished textile according to claim 2, characterized in that the finishing bath does not contain a catalyst.

4. Finished textile according to claim 1, characterized in that the finishing bath does not contain a catalyst.

5. In a crease resistant fabric containing cellulose fibers and made crease resistant by treatment with a cellulose cross-linking agent, the improvement wherein said crease-resistant fabric contains substantially no formaldehyde and said cross-linking agent consists essentially of phosphinicosuccinic acid, phosphinicobissuccinic acid or a mixture thereof.

* * * * *